US006095354A

United States Patent [19]

Herr et al.

[11] Patent Number: 6,095,354

[45] Date of Patent: Aug. 1, 2000

[54] CHILD RESISTANT CLOSURE AND CONTAINER

[75] Inventors: James E. Herr, East Petersburgh; Mark R. Fricke, Lancaster, both of Pa.

[73] Assignee: Kerr Group, Inc., Lancaster, Pa.

[21] Appl. No.: 09/280,809

[22] Filed: Mar. 30, 1999

[51] Int. Cl.[7] ..... B65D 55/02

[52] U.S. Cl. ..... 215/225; 215/235; 215/253; 222/153.14; 222/546; 222/556

[58] Field of Search ..... 215/224, 225, 215/201, 203, 206, 235, 250, 253, 256, 301; 220/281; 222/153.1, 153.14, 546, 556

[56] References Cited

U.S. PATENT DOCUMENTS

| | | | |
|---|---|---|---|
| Re. 29,793 | 10/1978 | Pehr | 222/153 |
| 3,439,825 | 4/1969 | Glensky | 215/40 |
| 3,469,725 | 9/1969 | Turner | 215/225 |
| 3,480,171 | 11/1969 | Rohde | 215/46 |
| 3,584,760 | 6/1971 | Grinker | 215/225 X |
| 3,604,585 | 9/1971 | Towns | 215/40 |
| 3,695,476 | 10/1972 | Ruekberg | 215/225 X |
| 3,877,598 | 4/1975 | Hazard | 215/224 |
| 4,330,067 | 5/1982 | Deussen | 215/220 |
| 4,371,088 | 2/1983 | Gach | 215/220 |
| 4,371,095 | 2/1983 | Montgomery et al. | 222/153 |
| 4,420,089 | 12/1983 | Walker et al. | 215/216 |
| 4,433,790 | 2/1984 | Gibson | 215/246 |
| 4,479,585 | 10/1984 | Sandhaus | 215/218 |
| 4,513,888 | 4/1985 | Curry | 222/153 |
| 4,527,701 | 7/1985 | Schaubeck | 215/220 |
| 4,573,599 | 3/1986 | Fillmore | 215/225 |
| 4,711,372 | 12/1987 | Gach | 222/23 |
| 4,727,999 | 3/1988 | Gach | 215/232 |
| 4,747,498 | 5/1988 | Gach | 215/232 |
| 4,759,455 | 7/1988 | Wilson | 215/206 |
| 4,775,065 | 10/1988 | Shastal | 215/235 |
| 4,782,964 | 11/1988 | Poore et al. | 215/216 |
| 4,787,525 | 11/1988 | Joyce | 215/201 |
| 4,795,043 | 1/1989 | Odet et al. | 215/235 |
| 4,801,029 | 1/1989 | Begley | 215/250 |
| 4,826,026 | 5/1989 | Gach et al. | 215/206 |
| 4,838,441 | 6/1989 | Chernack | 215/216 |
| 4,898,293 | 2/1990 | Morel | 215/250 |
| 4,940,167 | 7/1990 | Fillmore et al. | 222/153 |
| 4,941,592 | 7/1990 | Kitterman | 222/23 |
| 4,974,735 | 12/1990 | Newell et al. | 215/253 |
| 4,979,648 | 12/1990 | Montgomery et al. | 222/153 |
| 4,984,716 | 1/1991 | Beck | 222/153 |
| 4,993,606 | 2/1991 | Bolen, Jr. et al. | 222/546 |
| 5,054,633 | 10/1991 | Reijenga | 215/220 |
| 5,065,883 | 11/1991 | Udell | 220/276 |
| 5,065,911 | 11/1991 | Rohr et al. | 222/517 |
| 5,119,965 | 6/1992 | Arduca et al. | 215/251 |
| 5,129,531 | 7/1992 | Beck et al. | 215/256 |
| 5,147,053 | 9/1992 | Friedenthal | 215/216 |
| 5,147,054 | 9/1992 | Pehr | 215/253 |
| 5,161,706 | 11/1992 | Weinstein | 215/223 |
| 5,170,900 | 12/1992 | Manera | 215/218 |
| 5,183,171 | 2/1993 | Pherigo | 220/256 |
| 5,203,838 | 4/1993 | Schneider | 215/253 |
| 5,251,793 | 10/1993 | Bolen, Jr. et al. | 222/546 |

(List continued on next page.)

*Primary Examiner*—Stephen K. Cronin
*Attorney, Agent, or Firm*—Kenyon & Kenyon

[57] ABSTRACT

A closure according to the present invention includes an annular inner member defining an opening, the inner member having a camming recess. The closure also includes an outer member engageable with the inner member, the outer member including a lid base, a lid hingably connected to the lid base, and an annular guard ring surrounding the lid and lid base. The annular guard ring is frangibly connected to at least one of the lid and lid base, preferably along a frangible line formed by a plurality of bridges. The outer member can be formed integrally as one piece. When the inner member and outer member are joined, the guard ring preferably separates from the lid and lid base, and the lid base is at least partially retained within the camming recess. Once separated from the lid and lid base, the guard ring is movable between a guarding position in which it obstructs access to the lid, and a revealing position in which the lid can be rotated upward, away from the opening.

25 Claims, 6 Drawing Sheets

U.S. PATENT DOCUMENTS

| | | | |
|---|---|---|---|
| 5,341,947 | 8/1994 | Rossé | 215/230 |
| 5,348,201 | 9/1994 | Koo | 222/556 |
| 5,402,900 | 4/1995 | Glynn | 215/225 |
| 5,417,350 | 5/1995 | Koo | 222/556 |
| 5,462,183 | 10/1995 | Rohr et al. | 215/237 |
| 5,464,112 | 11/1995 | Guillot | 215/254 |
| 5,579,932 | 12/1996 | Drozd et al. | 215/207 |
| 5,622,273 | 4/1997 | Kelly | 215/237 |
| 5,685,444 | 11/1997 | Valley | 215/253 |
| 5,711,443 | 1/1998 | Bennett | 215/256 |
| 5,788,100 | 8/1998 | Sturk | 215/258 |
| 5,833,089 | 11/1998 | Manni et al. | 215/249 |

CHILD RESISTANT CLOSURE AND CONTAINER

FIELD OF THE INVENTION

The present invention relates to closures and containers, and in particular to closures and containers having child resistant features.

BACKGROUND INFORMATION

Many closures and containers include features making them difficult for children to open, thereby resisting improper access to the container contents. Often such child-resistant closures and containers are used for pharmaceutical products and similar products, which may be harmful if not used as directed or in the directed amount. For example, some containers include a series of locking lugs arranged around the circumference of the container which, in conjunction with lugs on the closure, require axial depression and then rotation of the closure to achieve removal from the container.

One problem associated with some child resistant closures and containers is that the manipulations required to achieve removal of the closure may be difficult. This may be especially true for the elderly or those afflicted with debilitating conditions such as arthritis. Other closures or containers which incorporate different types of child resistant features are often difficult to manufacture, requiring expensive molding operations, complicated post-molding manufacturing procedures, or both.

SUMMARY OF THE INVENTION

A closure according to the present invention includes an annular inner member defining an opening, the inner member having a lid base recess. The closure also includes an outer member engageable with the inner member, the outer member including a lid base, a lid hingably connected to the lid base, and an annular guard ring surrounding the lid and lid base. The annular guard ring is frangibly connected to at least one of the lid and lid base. Preferably, the components of the outer member are formed as an integral unit. When the inner member and outer member are joined, the guard ring preferably separates from the lid and lid base, and the lid base is retained at least partially within the lid base recess.

DETAILED DESCRIPTION

Figure 1:
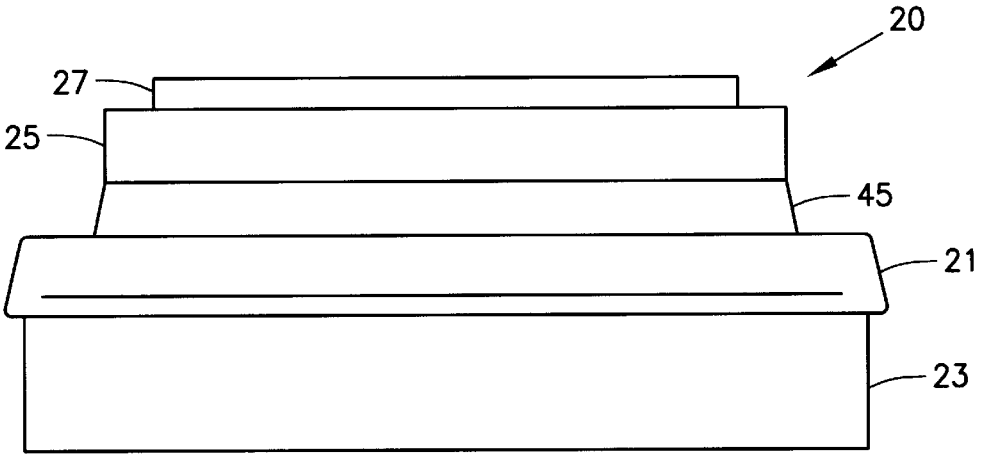
FIG. 1 is a side elevational view of an exemplary embodiment of an inner member of a closure according to the present invention.
Figure 2:
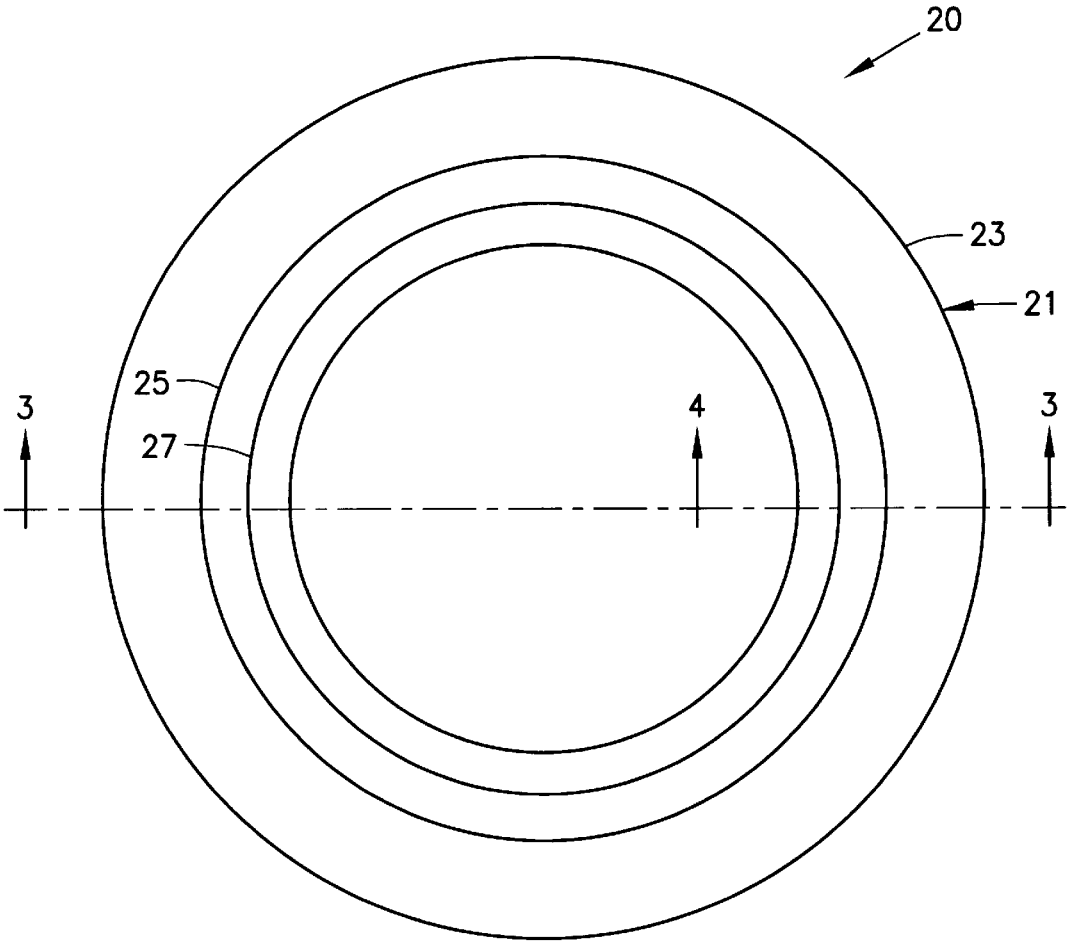
FIG. 2 is a top plan view of the inner member of FIG. 1.

FIGS. 1–4 illustrate an exemplary embodiment of an inner member 20 of a closure according to the present invention. In general, inner member 20 is formed to engage a container 90 (FIG. 10), preferably in such a way that the union of inner member 20 and container 90 is permanent, and inner member 20 defines an opening which allows access to the contents of container 90. Inner member 20 also acts as a base or support member for an outer member 60.

FIGS. 5 through 9 illustrate an exemplary embodiment of outer member 60. Outer member 60 generally includes a lid assembly 63 frangibly connected to a guard ring 61. When inner member 20 and outer member 60 are joined, lid assembly 63 and guard ring 61 preferably separate, each becoming connected to inner member 20. Lid assembly 63 covers the opening defined by inner member 20, and guard ring 61 provides a child resistant feature by selectively obstructing access to lid assembly 63 or allowing access to lid assembly 63.

In particular, the inner member 20 illustrated in FIGS. 1 through 4 includes a ring member 21. Ring member 21 preferably includes an annular first wall 23, an annular second wall 25 within first wall 23, and an annular third wall 27 within second wall 25. Walls 23, 25, 27 preferably share a common axis. In addition, in the embodiment of FIGS. 1 through 4, first wall 23, second wall 25 and third wall 27 are axially offset from one another. In this configuration, third wall 27 is above, or axially outward from, second wall 25, which in turn is above, or axially outward from, first wall 23.

Figure 3:
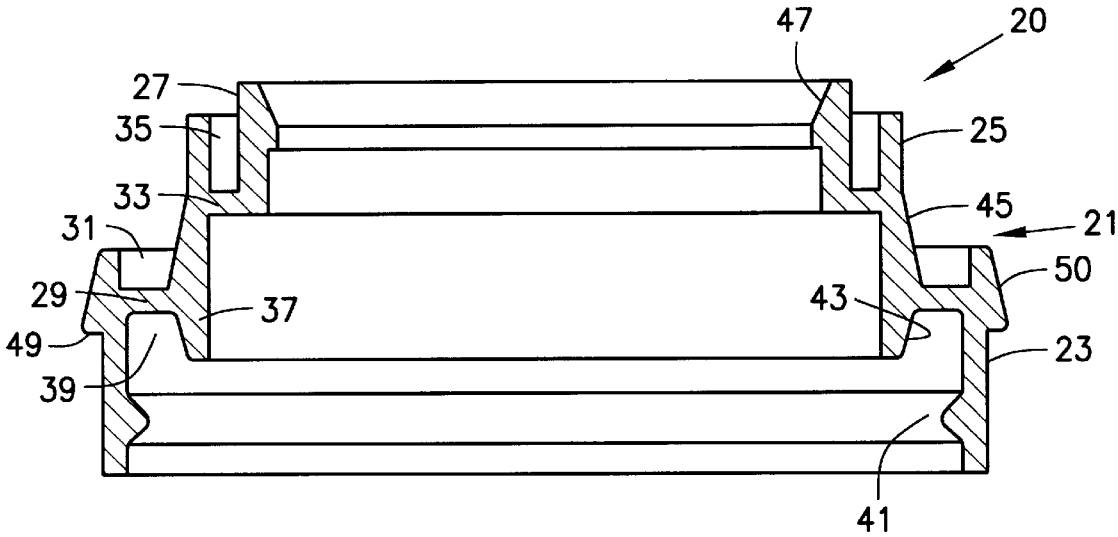
FIG. 3 is a cross-sectional, elevational view of the inner member of FIG. 1, taken along line 3—3 of FIG. 2.
Figure 4:
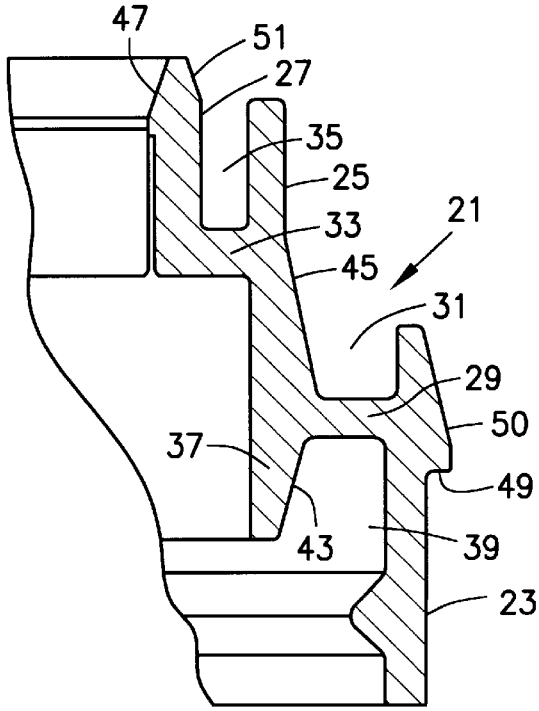
FIG. 4 is a cross-sectional, elevational view of a portion of the inner member of FIG. 1, taken along the line 4-3 of FIG. 2.

FIGS. 3 and 4 illustrate in further detail the preferred form of inner member 20. In this preferred form, first wall 23 is separated from second wall 25 by a lower bridge 29. First wall 23 and second wall 25 define a camming recess 31. Likewise, second wall 25 is separated from third wall 27 by upper bridge 33, and second wall 25 and third wall 27 define a lid base recess 35.

As noted above, inner member 20 is formed to engage container 90. In particular, second wall 25 includes an annular lower extension 37, which extends below lower bridge 29. Lower extension 37 and first wall 23 define a container recess 39, which receives the open end of container 90 when inner member 20 and container 90 are engaged. To facilitate the engagement of inner member 20 and container 90, inner member 20 may include an inner member retention formation. In the illustrated embodiment, inner member retention formation includes a bead 41 which engages a container retention formation (for example, shoulder 93) of container 90 to retain inner member 20 on container 90. Inner member 20 and container 90 may include other types of retention formations, including threads, lugs, or other suitable elements, if desired.

Inner member 20 illustrated in FIGS. 3 and 4 includes several beveled or angled surfaces. Lower extension 37 may include, for example, a beveled container centering surface 43 to provide additional tolerance between inner member 20 and container 90 as the two components are joined. Similarly, second wall 25 preferably includes a camming surface 45 disposed within camming recess 31, the purpose of which is discussed below. Third wall 27 can include an inner sealing surface 47 to provide, in conjunction with lid assembly 63, an effective seal of the closure. The outer surface of first wall 23 may include a guard ring centering surface 50 and shoulder 49, to facilitate application of outer member 60 to inner member 20 and to retain guard ring 61 on inner member 20.

Figure 5:
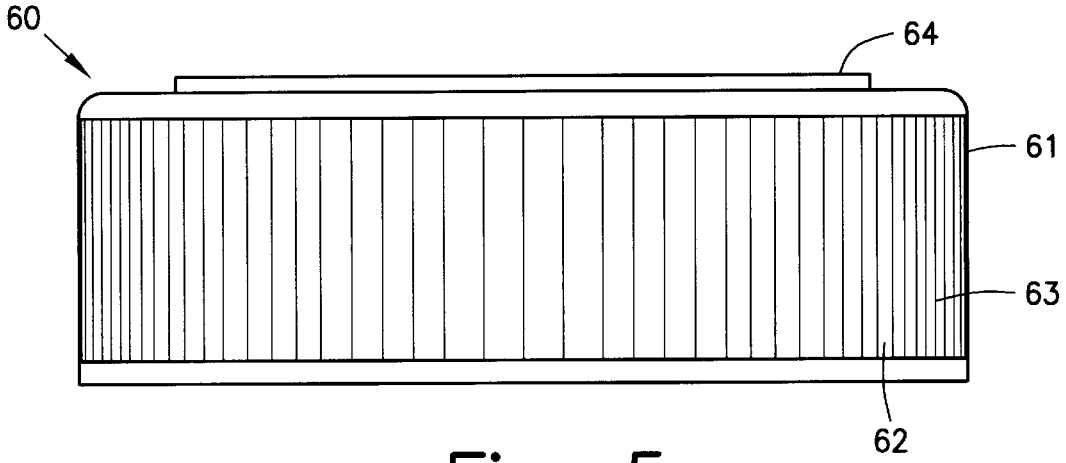
FIG. 5 is a side elevational view of an exemplary embodiment of an outer member of a closure according to the present invention.

FIGS. 5–9 illustrates a preferred outer member 60 of a closure according to the present invention. In particular, FIG. 5 shows an outer wall 62 of guard ring 61, which generally surrounds the other components of outer member 60. Preferably guard ring 61 includes a plurality of ridges 63 on its outer wall 62 (or some other suitable frictional feature) to provide an enhanced gripping surface for a user. Guard ring 61 may also include an upper shoulder 64 to provide structural support.

Figure 6:
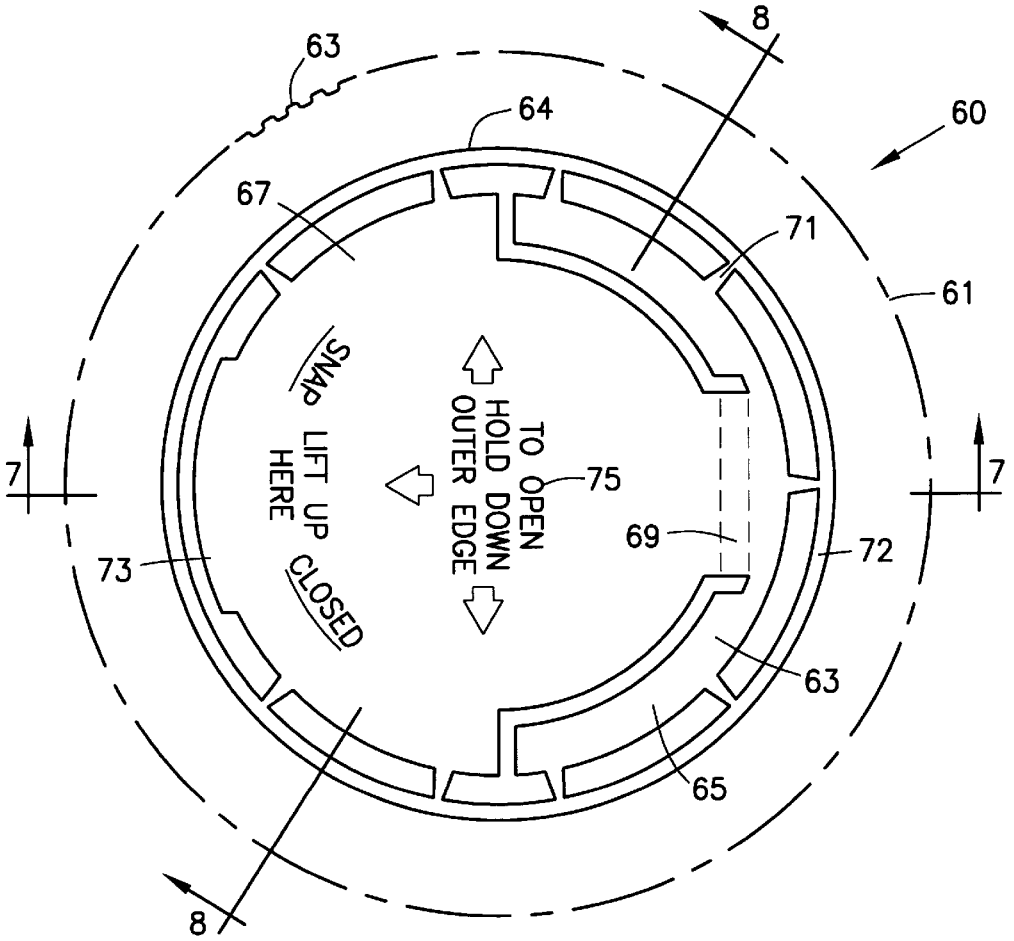
FIG. 6 is a top plan view of the outer member of FIG. 5.

As illustrated in FIG. 6, guard ring 61 is connected to a lid assembly 63. In particular, guard ring 61 is frangibly connected to at least one of lid base 65 and lid 67, and preferably is connected to both lid base 65 and lid 67 by a series of frangible bridges 71. Frangible bridges 71 are designed to rupture, separating guard ring 61 from lid assembly 63. This rupturing preferably occurs when outer member 60 is applied to inner member 20. In the illustrated embodiment, guard ring 61 and lid assembly 63 are integrally formed as one piece.

Lid assembly 63 includes lid base 65 and lid 67. While these elements may be constructed in any suitable shape and coupled in any suitable manner, lid base 65 is preferably semi-annular in shape (i.e., preferably forming half of a ring), while the top surface of lid 67 may be shaped so that lid 67 and lid base 65 together have a substantially circular profile, when viewed from above (i.e., lid 67 is preferably shaped as a central circular portion plus the other half of the "ring" defined by lid base 65). Lid 67 is hingably connected to lid base 65 by any suitable hinge 69. Lid 67 may also include a tab 73 to provide a protruding edge which is easily gripped by a user, as well as indicia 75 to instruct a user in the operation of the closure.

Figure 7:
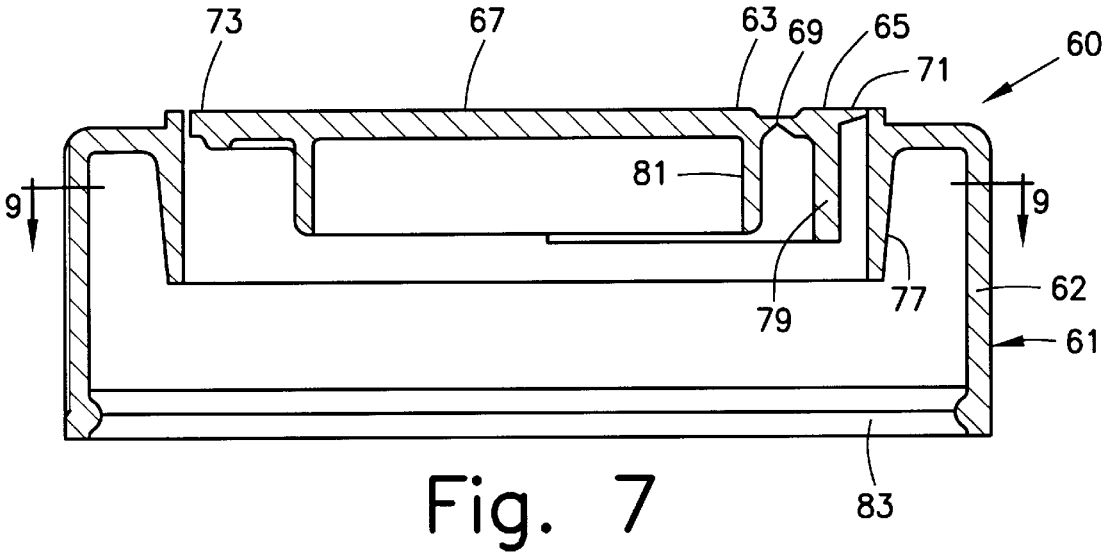
FIG. 7 is a cross-sectional view of the outer member of FIG. 5, taken along line 7—7 of FIG. 6.
Figure 8:
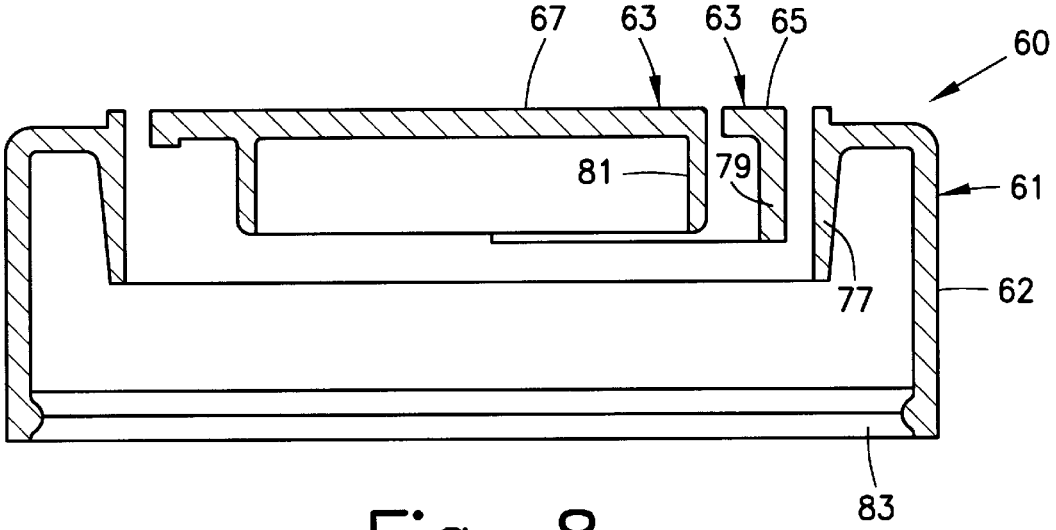
FIG. 8 is a cross-sectional view of the outer member of FIG. 5, taken along ling 8—8 of FIG. 6.
Figure 9:
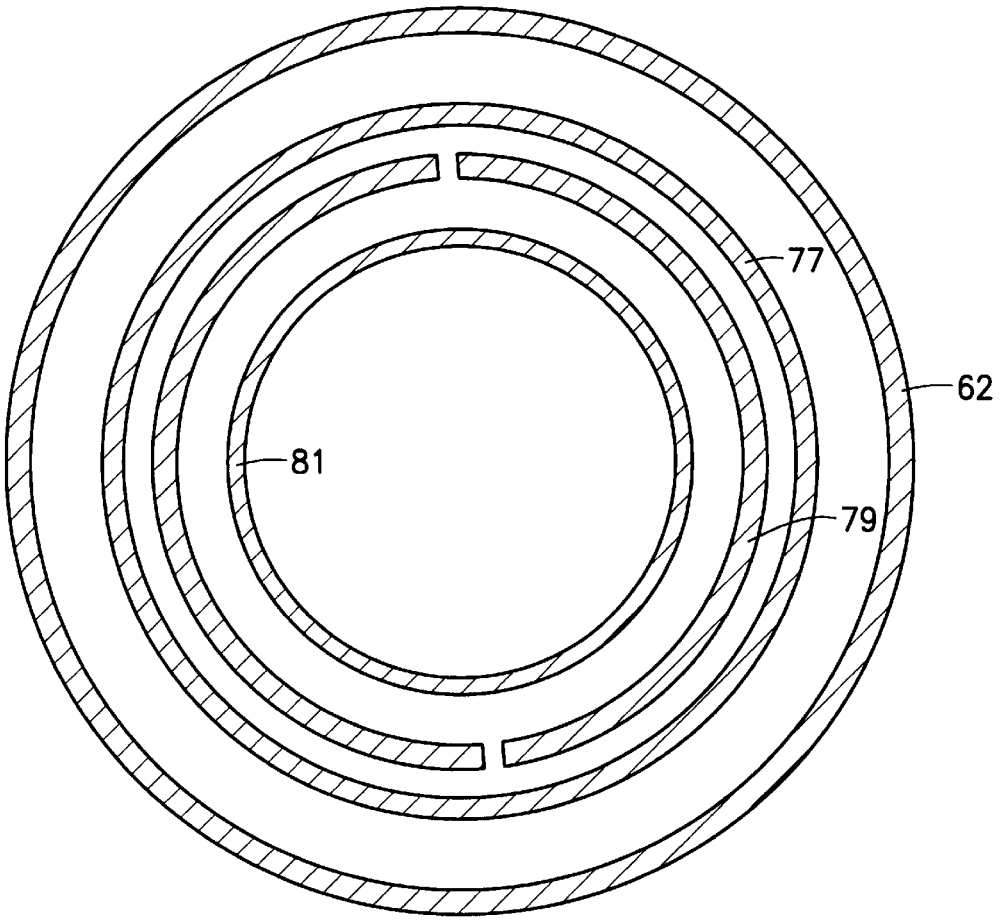
FIG. 9 is a bottom cross-sectional view of the outer member of FIG. 5, taken along line 9—9 of FIG. 7.

FIGS. 7 and 8 illustrate interior elements of outer member 60. Guard ring 61 includes a depending inner wall 77. Inner wall 77 is preferably maintained above or within camming recess 31 when outer member 60 and inner member 20 are joined. Guard ring 61 may also include any suitable sort of guard ring retention formation, such as a locking bead 83. Locking bead 83 may, for example, engage shoulder 49 of inner ring 20 to retain guard ring 61 on inner member 20. Lid base 65 can include a depending base wall 79, which is received in lid base recess 35 when outer member 60 is applied to inner member 20. Lid 67 preferably includes a depending sealing wall 81, which contacts sealing surface 47 to seal the opening of the closure. In the preferred embodiment, lid 67 is movable between a closed position in which lid 67 obstructs the opening and an open position in which it exposes the opening.

As noted above, when outer member 60 is applied to inner member 20, guard ring 61 preferably separates from lid assembly 63, with inner wall 77 preferably maintained above or within camming recess 31. With the two members 20, 60 assembled, guard ring 61 is generally axially maintained in a guarding position in which it obstructs access to the edge of lid 67 (for example the edge of tab 73). This position is illustrated in FIGS. 7 and 8. In operation, guard ring 61 is axially movable between this guarding position and a revealing position, in which guard ring 61 is depressed by the user. With guard ring 61 in the revealing position, the edge of lid 67 becomes accessible to the user, allowing the user to rotate lid 67 upward to uncover the opening defined by inner member 20.

When guard ring 61 is in the revealing position, the exemplary camming surface 45 applies an outward force to inner wall 77, straining inner wall 77 outwardly. The resulting compressive force provided by inner wall 77 against camming surface 45 creates an upward force against guard ring 61, biasing guard ring 61 toward the guarding position. In this manner, guard ring 61 and camming surface 45 provide a child resistant feature, requiring axial depression of guard ring 61 with respect to lid 67 to obtain access to the edge of lid 67. While other suitable biasing elements or springs may be employed to bias guard ring 61 to the guarding position, the preferred embodiment described here allows for simple and efficient manufacture.

Figure 10:
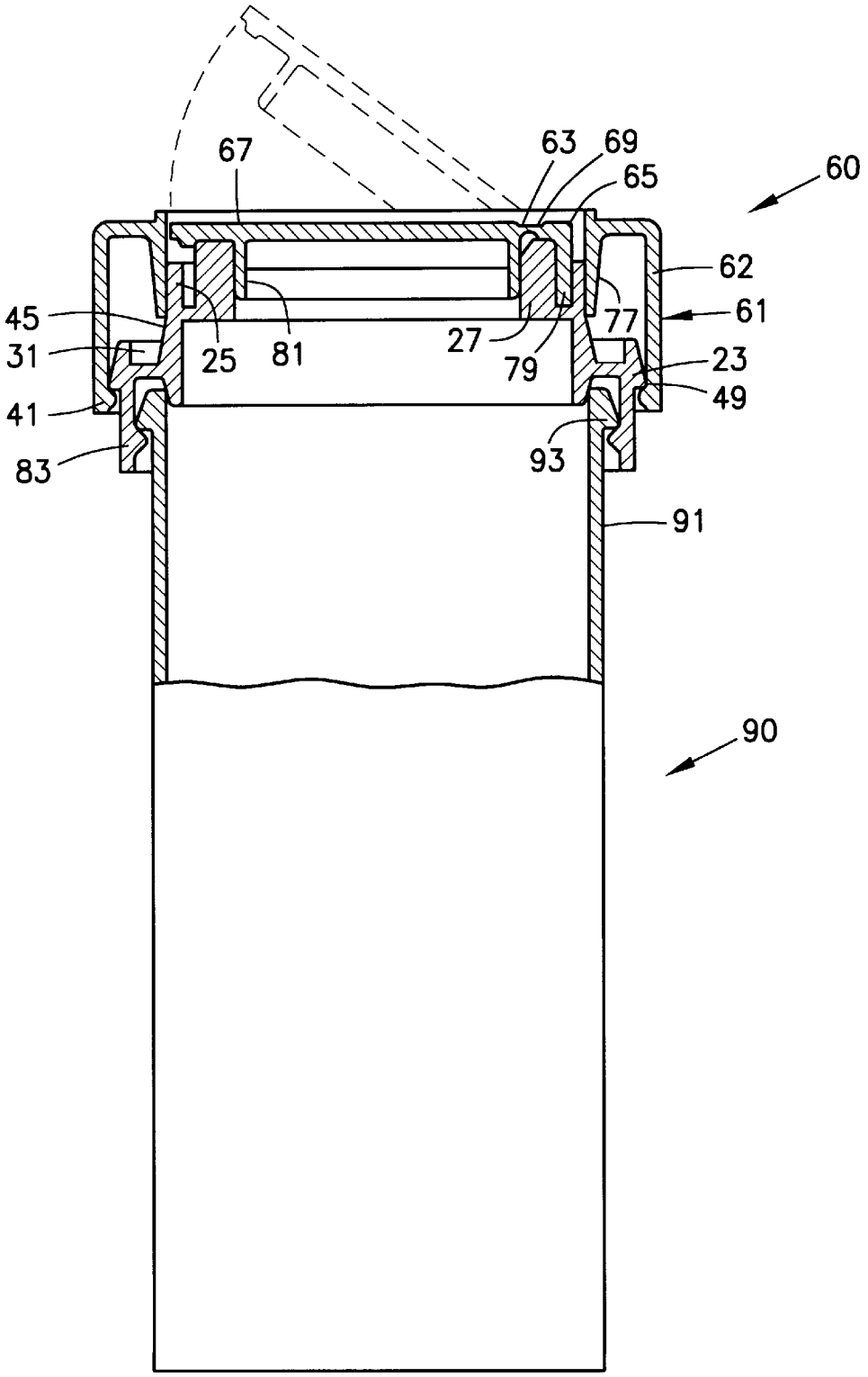
FIG. 10 is a partial cross-sectional view of an exemplary embodiment of a container according to the present invention with the inner member of FIG. 1 and the outer member of FIG. 5.

FIG. 10 shows an exemplary container 90 according to the present invention. In general, any suitable container may be used. Preferably, however, container 90 is substantially cylindrical in shape, or has a cylindrical neck. Container 90 may include a container retention formation, preferably a shoulder 93 disposed on an outer surface of side wall 91. Container retention formation contacts inner member 20 to retain inner member 20 on container 90.

Figure 11:
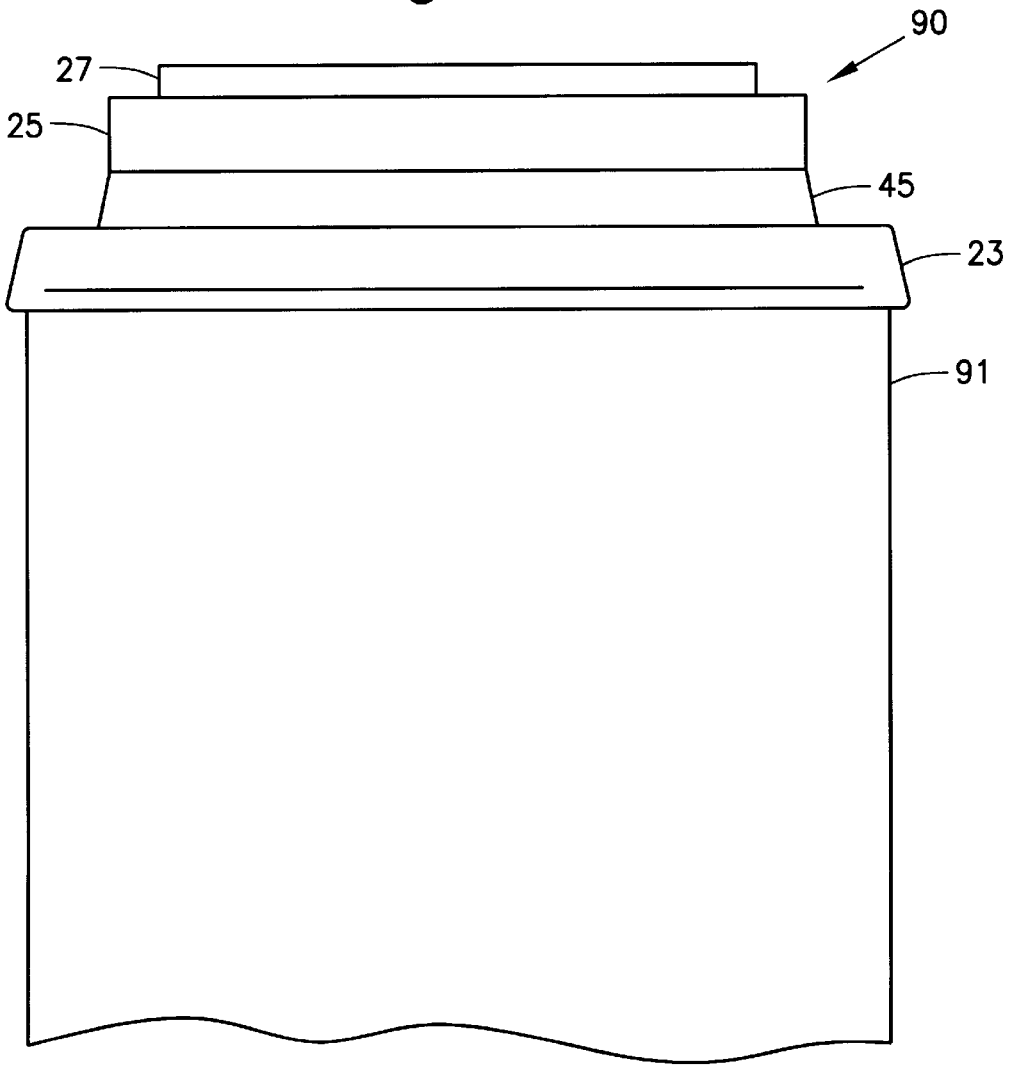
FIG. 11 is a side view of a second exemplary embodiment of a container according to the present invention.

FIG. 11 shows another exemplary embodiment of container 90 according to the present invention, in which elements of inner member 20 are formed integral with side wall 91 of container 90. In this embodiment, side wall 91 of container 90 may have the various elements and features described above with respect to inner member 20, and outer member 60 and container 90 may work in cooperation as described above.

In construction, inner member 20, outer member 60, and container 90 may be formed using any suitable process and using any suitable materials. Preferably, inner member 20 formed of a thermoplastic resin by injection molding. Outer member 60 is preferably formed integrally as one piece by injection or compression molding. Preferred materials for outer member 60 also include thermoplastic resins. Container 90 is preferably molded, for example by injection molding or stretch blow molding, from a plastic or thermoplastic resin such as polypropylene or polyethylene. Once formed, inner member 20 may be applied to container 90 (if the two elements are not formed integrally as described above), and then outer member 60 may be applied to inner member 20. Alternatively, inner member 20 and outer member 60 may be joined, and then the closure may be applied to container 90.

The closure and container according to the present invention have been described with respect to several exemplary embodiments. It can be understood, however, that there are many other variations of the above-described embodiments which will be apparent to those skilled in the art, even where elements have not explicitly been designated as exemplary. For example, lid assembly 63 and guard ring 61 could be connected by other forms of frangible connections. It is understood that this and other modifications are within the teaching of the present invention, which is to be limited only by the claims appended hereto.

What is claimed is:

1. A closure, comprising:

an annular inner member defining an opening; and an outer member engageable with the inner member, the outer member including:

a lid base;

a lid hingably connected to the lid base; and an annular guard ring surrounding the lid and lid base, the annular guard ring being frangibly connected to at least one of the lid and lid base.

2. The closure according to claim 1, wherein the inner member includes an annular first wall, an annular second wall, and an annular third wall, the first and second walls defining a camming recess and the second and third walls defining a lid base recess, the first wall including a retention formation, the retention formation engaging a container to retain the closure on the container.

3. The closure according to claim 2, wherein when the outer member engages the inner member, the guard ring separates from the lid and lid base, the guard ring being slidably retained on the inner member, the lid base being at least partly retained within the lid base recess, and the lid being selectively movable between a closed position in which the lid obstructs the opening and an open position in which the lid exposes the opening.

4. The closure according to claim 3, wherein the inner member includes a camming surface within the camming recess, the guard ring being movable between a guarding position in which the guard ring obstructs access to an edge of the lid, and a revealing position in which the guard ring reveals the edge of the lid, the camming surface biasing the guard ring to the guarding position.

5. The closure according to claim 3, wherein the third wall includes an inner sealing surface and wherein an interior surface of the lid includes a depending sealing ring, the sealing ring contacting the sealing surface when the lid is in the closed position to seal the opening.

6. The closure according to claim 3, wherein the first wall includes a shoulder and the guard ring includes an annular locking bead, and the shoulder forming an axial stop to retain the guard ring on the inner member.

7. The closure according to claim 1, wherein the lid, the lid base, and the guard ring are integrally formed as one piece.

8. The closure according to claim 7 wherein when the outer member is formed the guard ring is connected to at least one of the lid and the lid base by at least one frangible bridge.

9. The closure according to claim 8, wherein the inner member includes an annular first wall, an annular second wall, and an annular third wall, the first and second walls defining a camming recess and the second and third walls defining a lid base recess, the first wall including a retention formation, the retention formation engaging a container to retain the closure on the container.

10. The closure according to claim 8, wherein when the outer member engages the inner member, the at least one frangible member breaks and the guard ring separates from the lid and lid base, the guard ring being slidably retained on the inner member, the lid base being at least partly retained within the lid base recess, and the lid being selectively movable between a closed position in which it obstructs the opening and an open position in which it exposes the opening.

11. The closure according to claim 10, wherein the inner member includes a camming surface within the camming recess, the guard ring being movable between a guarding position in which a top surface of the guard ring obstructs access to an edge of the lid, and a revealing position in which the guard ring reveals the edge of the lid, the camming surface biasing the guard ring to the guarding position.

12. The closure according to claim 10, wherein the third wall includes an inner sealing surface and wherein an interior surface of the lid includes a depending sealing ring, the sealing ring contacting the sealing surface when the lid is in the closed position to seal the opening.

13. The closure according to claim 10, wherein the first wall includes a shoulder and the guard ring includes an annular locking bead, and the shoulder forming an axial stop to retain the guard ring on the inner member.

14. The closure according to claim 13, wherein when the outer member is formed, the guard ring is connected to the lid by a plurality of the frangible bridges and the guard ring is connected to the lid base by a plurality of the frangible bridges.

15. A closure and container, comprising:

a container including a side wall, the side wall including a container retention formation; and a closure, including:

an annular inner member defining an opening, the inner member having a lid base recess and the inner member having a closure retention formation, the closure retention formation engaging the container retention formation to retain the inner member on the container; and an outer member engageable with the inner member, the outer member including a lid base, a lid hingably connected to the lid base, and an annular guard ring surrounding the lid and lid base, the annular guard ring being frangibly connected to at least one of the lid and lid base;

wherein when the outer member engages the inner member, the guard ring separates from the lid and lid base, the guard ring being slidably retained on the inner member, the lid base being at least partly retained within the lid base recess, and the lid being selectively movable between a closed position in which it obstructs the opening and an open position in which it exposes the opening.

16. The closure and container according to claim 15, wherein the lid, the lid base, and the guard ring are integrally formed as one piece, the guard ring being connected to at least one of the lid and the lid base by at least one frangible bridge.

17. The closure according to claim 16, wherein the inner member includes an annular first wall, an annular second wall, and an annular third wall, the first and second walls defining a camming recess and the second and third walls defining the lid base recess.

18. The closure according to claim 17, wherein the inner member includes a camming surface within the camming recess, the guard ring being movable between a guarding position in which a top surface of the guard ring obstructs access to an edge of the lid, and a revealing position in which the guard ring reveals the edge of the lid, the camming surface biasing the guard ring to the guarding position.

19. A closure and container, comprising:

a container including a side wall, the side wall defining an opening and the side wall having a lid base recess; and a closure engagable with the container, the closure including a lid base, a lid hingably connected to the lid base, and an annular guard ring surrounding the lid and lid base, the annular guard ring being frangibly connected to at least one of the lid and lid base;

wherein when the closure engages the container, the guard ring separates from the lid and lid base, the guard ring being slidably retained on the container, the lid base being at least partly retained within the lid base recess, and the lid being selectively movable between a closed position in which it obstructs the opening and an open position in which it exposes the opening.

20. The closure and container according to claim 19, wherein the lid, the lid base, and the guard ring are integrally formed as one piece, the guard ring being connected to at least one of the lid and the lid base by at least one frangible bridge.

21. The closure and container according to claim 20, wherein the side wall includes an annular first wall, an annular second wall, and an annular third wall, the first and second walls defining a camming recess and the second and third walls defining the lid base recess.

22. The closure and container according to claim 21, wherein the side wall includes a camming surface within the camming recess, the guard ring being movable between a guarding position in which a top surface of the guard ring obstructs access to an edge of the lid, and a revealing position in which the guard ring reveals the edge of the lid, the camming surface biasing the guard ring to the guarding position.

23. A method of forming a closure and container including:

forming a container, the including a side wall, the side wall including a container retention formation;

forming an annular inner member, the annular inner member defining an opening, the inner member having a lid base recess and the inner member having a closure retention formation, the closure retention formation engageable with the container retention formation to retain the inner member on the container; and forming an outer member, the outer member engageable with the inner member, the outer member including a lid base, a lid hingably connected to the lid base, and an annular guard ring surrounding the lid and lid base, the annular guard ring being frangibly connected to at least one of the lid and lid base;

placing the inner member on the container so that the closure retention formation contacts the container retention formation to retain the inner member on the container; and placing the outer member on the inner member.

24. The method according to claim 23, wherein when the outer member is placed on the inner member, the guard ring separates from the lid and lid base, the guard ring being slidably retained on the inner member, the lid base being at least partly retained within the lid base recess, and the lid being selectively movable between a closed position in which it obstructs the opening and an open position in which it exposes the opening.

25. The method according to claim 23, wherein the outer member is formed integrally as one piece.

* * * * *

UNITED STATES PATENT AND TRADEMARK OFFICE

CERTIFICATE OF CORRECTION

PATENT NO. : 6,095,354
DATED : August 1, 2000
INVENTOR(S) : HERR et al.

It is certified that error appears in the above-identified patent and that said Letters Patent is hereby corrected as shown below:

Column 1, line 65, after "taken along" change "ling" to -- line -- ;

Column 7, line 16, after "container," delete "the".

Signed and Sealed this

First Day of May, 2001

*Attest:*

Nicholas P. Godici

NICHOLAS P. GODICI

*Attesting Officer*

*Acting Director of the United States Patent and Trademark Office*